United States Patent [19]

Kim et al.

[11] Patent Number: 4,466,939

[45] Date of Patent: Aug. 21, 1984

[54] PROCESS OF PRODUCING COPPER-ALLOY AND COPPER ALLOY PLATE USED FOR MAKING ELECTRICAL OR ELECTRONIC PARTS

[75] Inventors: Young G. Kim, Seoul; Dong K. Park, Incheon, both of Rep. of Korea

[73] Assignee: Poong San Metal Corporation, Incheon, Rep. of Korea

[21] Appl. No.: 534,893

[22] Filed: Sep. 22, 1983

[30] Foreign Application Priority Data

Oct. 20, 1982 [KR] Rep. of Korea ..... 4714/82[U]

[51] Int. Cl.[3] ..... C22C 9/06; C22F 1/08

[52] U.S. Cl. ..... 420/485; 148/11.5 C; 148/12.7 C; 420/487

[58] Field of Search ..... 148/11.5 C, 12.7 C, 148/435, 414; 420/485, 487

[56] References Cited

U.S. PATENT DOCUMENTS

| | | | |
|---|---|---|---|
| 3,522,112 | 7/1970 | McLain | 148/12.7 C |
| 4,249,941 | 2/1981 | Futatsuka et al. | 420/473 |
| 4,337,089 | 6/1982 | Arita et al. | 148/12.7 C |
| 4,362,579 | 12/1982 | Tsuji | 420/481 |

FOREIGN PATENT DOCUMENTS

| | | | |
|---|---|---|---|
| 104449 | 8/1980 | Japan | 420/485 |
| 77354 | 6/1981 | Japan | 420/481 |
| 2850 | 1/1982 | Japan | 420/485 |
| 116738 | 7/1982 | Japan | 420/485 |
| 109357 | 7/1982 | Japan | 420/485 |
| 109356 | 7/1982 | Japan | 420/485 |

*Primary Examiner*—Peter K. Skiff

*Attorney, Agent, or Firm*—Armstrong, Nikaido, Marmelstein & Kubovcik

[57] ABSTRACT

This invention provides an economic copper-nickel alloy having high strength and high conductivity for lead conductor materials and/or lead frames for transistors, integrated circuits, and the like. The copper alloy comprises a composite of copper and inexpensive elements comprising 3.0% by weight nickel; from 0.01 to 1.0% by weight silicon; and from 0.01 to 0.1% by weight phosphorus. In one preferred embodiment a specific weight % of iron is also added. Still further, an improved method is provided for fabricating the alloy according to a specific series and sequence of steps, including steps at specific conditions and for specific times, for providing precipitation hardening. Other advantageous properties comprise desirable elongation.

17 Claims, 2 Drawing Figures

PROCESS OF PRODUCING COPPER-ALLOY AND COPPER ALLOY PLATE USED FOR MAKING ELECTRICAL OR ELECTRONIC PARTS

BACKGROUND OF THE INVENTION

In the field of metallurgy, it is advantageous to provide high strength, high conductivity, copper-base alloys. It is also advantageous to provide a method for producing high tensile strength, high electrical conductivity, copper-base alloys, and copper alloy plate, in an economical manner with desirable fabrication characteristics for making electrical or electronic parts.

To this end, copper by itself has excellent electrical conductivity and other characteristics. However, copper by itself is deficient in tensile strength for many applications. Thus, extensive research has long been undertaken to increase the tensile strength of the copper by adding alloying elements thereto, such as tin, manganese, silver, zinc, cobalt, titanium, chrominum and zirconium. In particular, the tensile strength of the copper has been increased by adding tin as an alloy element, as described in Japanese Patent Applications Nos. 52-78621 and 53-89662, as well as U.S. Pat. No. 4,337,089. However, the electrical conductivity of the resulting alloys has been so reduced that these alloys have not been suitable for the lead frames of transistors or integrated circuit, which require a high tensile strength and a high electrical conductivity respectively. These tensile strengths are in the range of greater than at least about 40 kg/mm$^2$. These electrical conductivities have been in the range of at least about 60% or more of the conductivity of pure copper, which is referred to as a conductivity percent IACS, as referred to in the above mentioned U.S. Pat. No. 4,337,089.

It has also been advantageous to improve the fabrication characteristics and the method for making copper-nickel alloys by reducing the brittleness and the hot working steps known heretofore, and/or by reducing the poor workability in the heretofore known reduction ratios of the cold working, which resulted from adding such alloying elements as tin, or too much of some other elements, such as the above mentioned elements.

It has still further been advantageous to reduce the cost of the cooper-nickel alloys heretofore by eliminating expensive alloying elements, such as tin and/or manganese, by reducing the amounts of the additives, and/or by finding cheaper additives.

Still further, it has been advantageous to improve the elongation characteristics of the copper-nickel alloys known heretofore for the above mentioned applications, including the mentioned lead frames for transistors and/or integrated circuits.

SUMMARY OF THE INVENTION

In accordance with this invention, it has been discovered that certain additives may be eliminated from the heretofore known alloys. These additives comprise tin, manganese, silver, zinc, cobalt, titanium, chrominum and zirconium.

This invention provides an economic copper-nickel alloy containing the following weight percents of elements: from about 0.05 to about 3.0% by weight nickel; from about 0.01 to about 1.0% by weight silicon; and from about 0.01 to about 0.1% by weight phosphorus.

This invention also involves a novel method of fabricating copper-nickel alloys economically for electrical or electronic parts requiring high tensile strength and high electrical conductivity, such as the above mentioned strengths and conductivities.

This invention also provides an economical method of fabricating a copper-nickel alloy with elements selected from the group consisting of nickel, silicon, phosphorus, iron and copper. To this end, this process, comprises the steps of economically casting these elements into a copper-base alloy, wherein the alloy is hot rolled at a temperature of between about 750° to about 950° C.; rapidly cooling the hot rolled alloy; cold rolling the resultant alloy with a size reduction of between about 60% to 80%; annealing the resultant product at a temperature of between about 400° C. to about 520° C. for about two hours; rapidly cooling the resultant product; cold rolling the resultant product with a size reduction of between about 50% to about 70%; annealing the resulting product at a temperature of between about 400° C. to about 520° C. for about two hours; rapidly cooling the resultant product; cold rolling the resultant product with a size reduction of between about 50% to about 70%; and low temperature annealing the resultant product at a temperature of between about 250° C. and about 400° C.

In another aspect, this invention provides a novel precipitation hardened alloy and method for producing a product with improved elongation characteristics.

With the proper selection of elements and their amounts, as well as the proper selection of steps and their sequence during fabrication, as described in more detail hereinafter, the desired high tensile strength, high electrical conductivity, copper-nickel alloy is achieved with the desired elongation and other fabrication characteristics.

Accordingly, it is an object of this invention to provide and to fabricate improved copper-nickel alloys having the required high tensile strength, high electrical conductivity, and other characteristics;

It is a further object of the present invention to produce economical copper-nickel alloys with excellent properties by using easily obtainable and inexpensive elements;

It is another object to provide a copper-nickel alloy with high electrical conductivity and also high tensile strength for lead frames for transistors, integrated circuits, and the like;

It is another object to provide alloying additives that can be easily utilized industrially without difficulty;

It is another object to provide an improved precipitation hardening method;

It is another object to provide ways of increasing the tensile strength of copper-nickel alloys;

It is another object to provide precipitation hardening type alloys;

It is a still further object to provide a copper-nickel alloy by a precipitation method of fabrication that increases the strength and does not decrease the electrical conductivity and elongation of the alloy by adding specific weight percents of nickel, phosphorus and silicon to the copper, and/or by adding specific weight percents of iron, nickel, phosphorus, and silicon to the copper.

The above and further novel features and objects of this invention will become apparent from the following detailed description of preferred embodiments of this invention when read in connection with the accompanying drawings, and the novel features will be particularly pointed out in the appended claims. It is to be expressly understood, however, that the drawings are not intended as a definition of the invention, but are for the purposes of illustration only.

DETAILED DESCRIPTION OF THE PREFERRED EMBODIMENT

Figure 1:
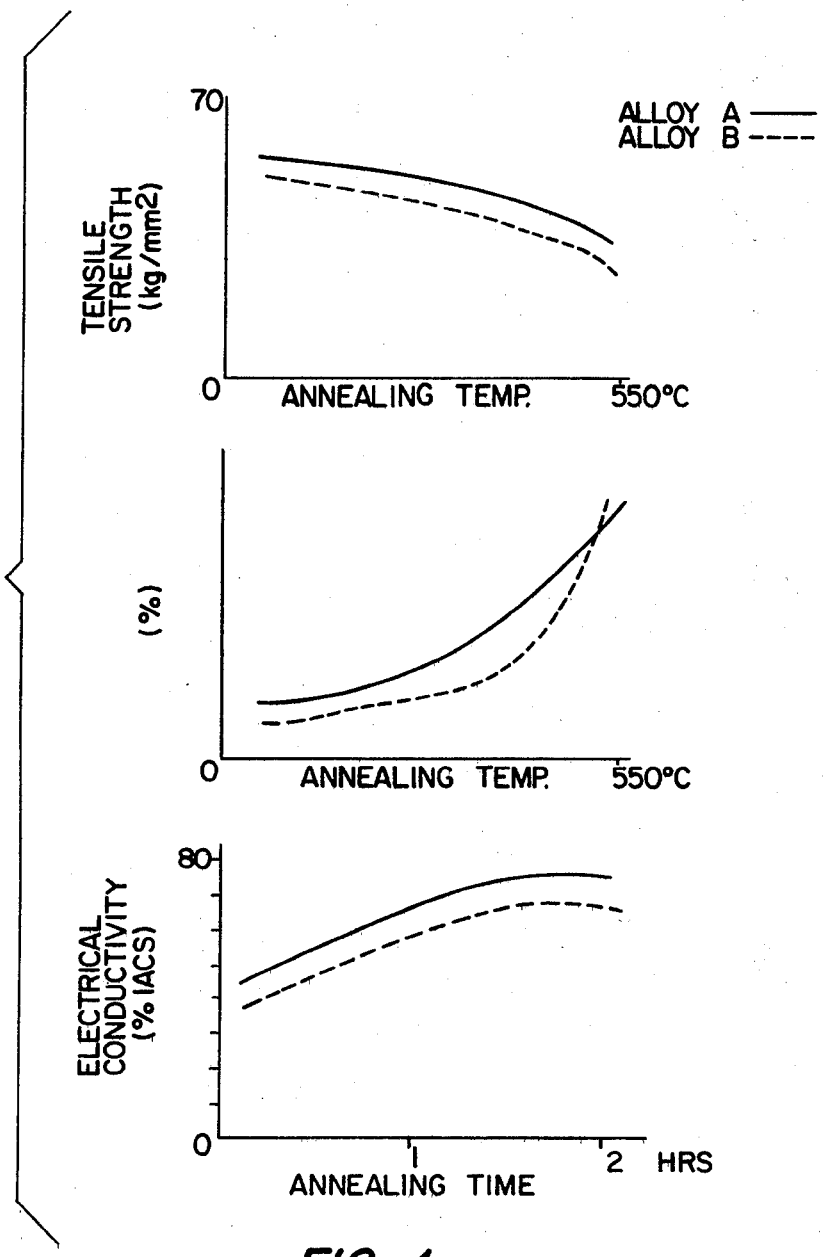
FIG. 1 is a graphic representation of the variation of the physical properties as a function of the annealing temperatures and times of one embodiment of the copper-nickel (A) alloys of this invention and conventional copper alloys (B) having added elements that are elminated by this invention.

This invention is useful for lead frames and conductors for transistors and integrated circuits requiring high tensile strength and high electrical conductivity. The required tensile strength is in the range of above at least about 40 kg/mm$^2$, and the required conductivities are in the range of at least about 60% of the electrical conductivity of pure copper. However, this invention is also useful in any application where such tensile strengths and electrical conductivities, or even higher of selected of these characteristics are required.

In one preferred embodiment, this invention provides copper-nickel alloys for electrical lead conductor materials for integrated circuits containing a composite of copper and from about 0.05 to about 3.0% by weight nickel, from about 0.01 to about 1.0% by weight silicon, and from about 0.01 to about 0.1% by weight phosphorus.

In another preferred embodiment this invention also provides copper-nickel alloys for electrical lead conductor materials for integrated circuits containing a composite of copper and the additives of claim 1, wherein about 0.01 to about 3.0% by weight iron is also added to the composite of said alloys and then alloyed therewith.

In the preferred embodiment of the method of this invention, this invention comprised the following steps and sequence of melting, hot working and cold working stages:

first, in the melting stage, a pure copper ingot without additives is charged into a crucible in a furnace and the copper is melted completely. Thereafter, the copper melt is heated to approximately 1300° C. Nickel or iron are then added to the melt. The melt is then deoxydized with phosophorus and silicon, which are enveloped with copper foil, which is added into the melt and melted therewith. The final step in this stage is a rapid cooling step to form a casting.

The hot working stage, includes a hot working step at a temperature of between about 750° C. and about 950° C. This step includes hot rolling the casting into a size reduced element in order to accomplish the solution treatment of the rapidly cooled melt from the first melting stage. Subsequently to this hot working step, the resulting solution treated and size reduced element is rapidly cooled.

In the following cold working stage, cyclic cold working is performed with a size reduction of between about 60 to about 80%. After each cold working cycle, the resulting cold worked element is annealed in a cycle at a temperature of between about 400° C. to about 520° C. for aging treatment and recrystallization. The cycle of these respective sequential cold working and annealing steps is performed three times altogether.

By the foregoing process the material of the present invention can be shown to have more than about 60% (IACS) of the electrical conductivity of pure copper without any additives, a tensile strength of about from 40 to about 62.7 kg/mm$^2$, and about >3% elongation, which properties are quite suitable for the requirements of the lead frames for electronic circuit elements, such as semiconductors, transistors and integrated circuits. However, as will be understood in more detail hereinafter, this invention and the process for making the material of the present invention can be shown to have a wide application due to a desirable range of properties.

Moreover, the described invention has the advantage that its manufacturing cost is low. To this end, the material of the present invention contains relatively small amounts of expensive alloying elements, and has additives that are relatively inexpensive. Also, the workability of the material of this invention is good.

Still further, the high tensile strength, high electrical conductivity and high elongation nickel-copper alloy obtained may be used for many applications requiring severe bending.

The present invention will be more readily understood from a consideration of the following illustrative examples:

EXAMPLE 1

Using a medium frequency induction furnace in air, alloys having the compositions of table 1 are melted at about 1200° C. and then cast by rapid cooling. In this melting step, high purity copper without additives is charged into the furnace first, and after the melt-down the melt is covered with charcoal.

Subsequently to this described heating and melting, which is at approximately 1200° C., the charcoal is removed, and the melt is heated to about 1320° C. in order to add nickel, or nickel-iron, which may be in an alloy form, and, after putting the nickel or the nickel-iron in, all these elements are melted and mixed thoroughly together.

Then after deoxydizing with phosphorus, silicon is added and the melt is brought to the pouring temperature. The melt is then poured and made into an ingot.

The ingot is hot rolled at a temperature of between about 750° C. to about 950° C. so that it has a thickness of between about 7 to about 9 mm, and then the material is rapidly cooled.

The hot rolled and rapidly cooled material is cold rolled with a reduction in size of about 70%, which is controlled as to gauge to be about 2 to about 2.5 mm thick. The material is then brought to an annealing temperature of between about 450° C. to about 480° C., and is again cold rolled with a size reduction of about 65%, which is controlled to a gauge to about 0.8 mm. Then it is annealed at a temperature of between about 460° C. to about 500° C., and further controlled to a desired gauge in a final cold rolling step, wherein the thickness is made to approximate a 0.25 mm thickness. Then it is low temperature annealed at a temperature of between about 250° to about 400° C.

The results are shown in Table 2, and curves of the physical properties versus the temperatures and times of the final low temperature annealing are given in FIG. 1.

EXAMPLE 2

Using a medium frequency induction furnace, alloys having the compositions of Table 1 are melted at about 1200° C. for casting by a rapid cooling step, as described in the above mentioned Example 1. In this melting step high purity copper without any additives is charged into the furnace first, at about 1200° C., and after meltdown the melt is covered with charcoal, also as described in the above mentioned Example 1.

Subsequently to the described heating and melting step at approximately 1200° C., the charcoal is removed, the melt is heated to about 1320° C., and then nickel is put into the melt. After complete melting, the melt is deoxydized with phosphorus and then brought to a lower temperature.

Thereafter, a silicon ingot, which is enveloped by a high purity copper foil without any additives, is added into the melt. After complete melting, the melt is cast into an ingot.

The ingot is hot rolled at a temperature of between about 750° C. and about 950° C. to a thickness of about 7 to about 9 mm, and then the material is rapidly cooled.

The hot rolled material is cold rolled with a reduction of about 70% in size, which is controlled to a gauge of about 2 to about 2.5 mm.

The material is then brought to an annealing temperature of between about 470° C. to about 520° C. and is again cold rolled to bring about a 65% size reduction, which is controlled as to gauge to about 0.8 mm. Then the resulting material in annealed at a temperature of between about 470° C. to about 520° C., cold rolled to approximately 0.33 mm in thickness, annealed at a temperature of between about 350° to about 450° C., which is controlled as to gauge in a final cold rolling to about 0.254 mm, and then annealed at a low temperature.

Figure 2:
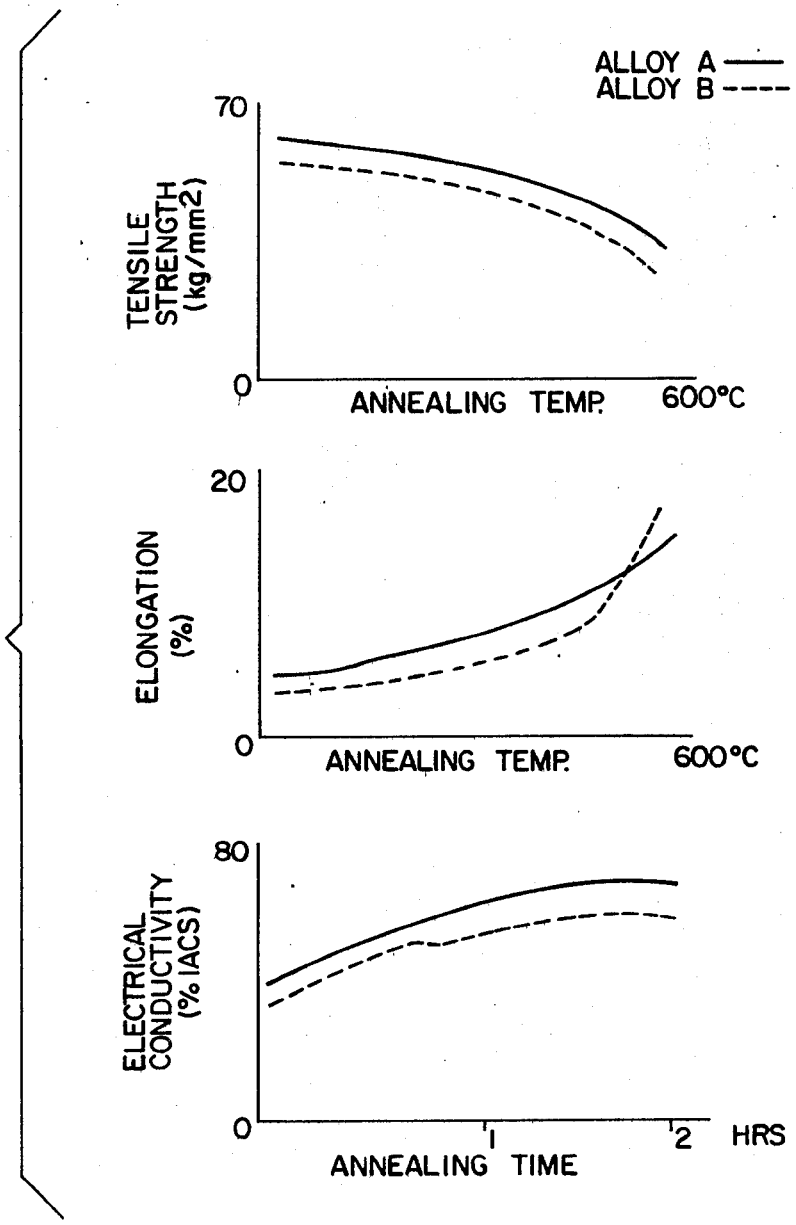
FIG. 2 is a graphic representation of the variation of the physical properties as a function of the annealing temperatures and times of the copper alloy (A') of another embodiment of the present invention and the conventional alloys (B) of FIG. 1.

The results are shown in Table 3. The changes of the physical properties versus the temperatures and the times of the final low temperature annealing are shown in FIG. 2.

EXAMPLE 3

In another example the steps and procedures of the preceeding examples were followed. The additives were selected to produce a composite having the following weight %; nickel=1%, phosphorus=0.03%, silicon=0.2% and the balance was copper.

EXAMPLE 4

In another example, the steps and procedures of the preceeding examples 1 through 2 were followed. The additives were selected to produce an alloy having the following weight percents: iron=0.7%, nickel=0.5%, phosphorus=0.03%, silicon=0.1% and the balance was copper.

This invention has the advantage of providing an economic new high tensile strength, high conductivity copper alloy for electrical and electronic equipment, such as leads and lead frames for transistors and integrated circuits. To this end, this invention has the advantage of using specific amounts of the inexpensive group of elements, consisting of nickel, silicon, phosphorus, iron and copper. Also this invention has the advantage of providing an improved method of making such an alloy, including a specific sequence of specific steps. The specific steps produce precipitation hardening, as will be understood from the above description by one skilled in the art. Also the alloys and method of this invention have other desirable characteristics, including the production of economic elongations at which bending can advantageously take place.

In one embodiment, this invention has the advantage of providing the following weight percent of inexpensive elements: 0.05 to 3.0% by weight nickel, 0.01 to 1.0% by weight silicon, and from 0.01 to 0.1% by weight phosphorus.

In another preferred embodiment this invention has the advantage of adding the inexpensive iron in a specific weight percent, of achieving precipitation hardening, and/or of eliminating the elements used heretofore in copper alloys. These elements that were eliminated by this invention, comprise tin, manganese, silver, zinc, cobalt, titanium, chromonium, and zirconium.

TABLE 1

| | (in weight %'s) | | | | |
|---|---|---|---|---|---|
| | Ni (%) | Si (%) | P (%) | Fe (%) | Cu (%) |
| A1 | 0.1 | 0.1 | 0.03 | — | Balance |
| A2 | 1.0 | 0.1 | 0.03 | — | " |
| A3 | 1.0 | 0.2 | 0.03 | — | " |
| A4 | 0.5 | 0.1 | 0.03 | 0.7 | " |
| A5 | 0.5 | 0.1 | 0.03 | — | " |

TABLE 2

| | Tensile Strength (Kg/mm$^2$) | Elongation (%) | Hardness Hv | Electrical Conductivity (IACS) (% of the conductivity of pure copper) |
|---|---|---|---|---|
| A1 | 48.3 | 3.2 | 135 | 63 |
| A2 | 58.5 | 4.9 | 165 | 62 |
| A3 | 64.2 | 6.1 | 175 | 64 |
| A4 | 54.4 | 4.0 | 143 | 60 |
| A5 | 54.7 | 5.1 | 151 | 67 |

TABLE 3

| | Tensile Strength (Kg/mm$^2$) | Elongation (%) | Hardness (Hv) | Electrical Conductivity IACS (%) |
|---|---|---|---|---|
| A1 | 40.1 | 13.5 | 116 | 65 |
| A2 | 52.4 | 7.2 | 149 | 64 |
| A3 | 62.7 | 6.7 | 175 | 68 |
| A4 | 53.3 | 6.7 | 140 | 62 |
| A5 | 53.1 | 6.1 | 144 | 67 |

What is claimed is:

1. Copper-nickel alloys for electrical lead conductor materials for integrated circuits consisting essentially of copper and from about 0.05 to 3.0% by weight nickel, from about 0.01 to 1.0% by weight silicon, and from about 0.01 to 0.1% by weight phosphorus.

2. Copper-nickel alloys for electrical lead conductor materials for integrated circuits consisting essentially of copper and additives according to claim 1, wherein 0.01 to 3.0% iron is added to said alloys and then alloyed therewith.

3. A method for producing an alloy consisting essentially of copper and from about 0.05 to about 3.0% by weight nickel, from about 0.01 to about 1.0% by weight silicon, from about 0.01 to about 0.1% by weight phosphorus, and optionally 0.01 to 3.0% iron for electrical lead conductor materials integrated circuits comprising as sequential steps:

(a) casting the composites of claims 1 or 2;

(b) hot rolling the casting at a temperature of between about 750° to 950° C.;

(c) rapidly cooling the rolled casting;
(d) cold rolling the casting with a reduction in size of about 60 to 80%;
(e) annealing the casting at a temperature of between about 400° C. to 520° C. for about two hours;
(f) rapidly cooling the resulting product;
(g) again cold rolling the resulting product with a reduction in size of about 50 to 70%;
(h) annealing the resulting product at a temperature of between about 400° C., to 520° C. for about two hours;
(i) rapidly cooling the resulting product;
(j) finally cold rolling the casting with a size reduction of about 50 to 70%;
(k) low temperature annealing the resulting product at a temperature of between about 250° C. to 400° C.

4. A method for producing an alloy consisting essentially of copper and from about 0.05 to about 3.0% by weight nickel, from about 0.01 to about 1.0% by weight silicon, from about 0.01 to about 0.1% by weight phosphorus, and optionally 0.01 to 3.0% iron for electrical lead conductor materials for integrated circuits comprising as sequential steps:
(a) casting the alloys of claims 1 or 2;
(b) the alloy is hot rolled at a temperature of between 750° to 950° C. and rapidly cooled;
(c) wherein said alloy is first cold rolled with a size reduction of about 60 to 80%;
(d) said alloy is then annealed at a temperature of between about 400° C. to 520° C. for about two hours and rapidly cooled;
(e) said alloy is secondly cold rolled with a size reduction of about 50 to 70%;
(f) said alloy is annealed at a temperature of between about 400° C. to 520° C. for about two hours and rapidly cooled;
(g) said alloy is cold rolled with a reduction of about 30 to 50%;
(h) said alloy is annealed at a temperature of between about 350° C. to 500° C. for about two hours;
(i) said alloy is finally rolled with a reduction in size of between about 10 to 25%;
(j) said alloy is low temperature annealed at a temperature of between about 250° C. to 400° C.

5. The copper-nickel alloys of claim 1 in which the alloys were made by adding elements to form an alloy having the following weight percents: nickel=1%, phosphorus=0.03% silicon=0.2% and the balance copper.

6. The copper-nickel alloys of claim 2 in which the alloys were made by adding elements to form an alloy having the following weight percents: iron=0.7%, nickel=0.5%, phosphorus=0.03%, silicon=0.1% and the balance copper.

7. Copper-nickel alloys for electrical lead conductor materials for integrated circuits consisting essentially of copper and from about 0.05 to about 3.0% by weight nickel, from about 0.01 to about 1.0% by weight silicon, from about 0.01 to about 0.1% by weight phosphorus, and optionally 0.01 to 3.0% iron having a tensile strength of greater than about 40 kg/mm$^2$.

8. The copper-nickel alloys of claim 7 having a conductivity of at least about 60% of the conductivity of pure copper.

9. The copper-nickel alloys of claim 8 in which the alloy has an elongation of between about 3.2% and 13.5%.

10. The copper-nickel alloys of claim 9 in which the alloy has a hardness of between about 16 to 175 HV.

11. The copper-nickel alloys of claim 10 in which the tensile strength is at least between about 40.1 and 62.7 kg/mm$^2$.

12. The copper-nickel alloys of claim 11 in which the conductivity is at least between about 60% and 70% of the conductivity of pure copper.

13. The copper-nickel alloys of claim 12 in which the alloy consists essentially of copper and from about 0.05 to about 3.0% by weight nickel, from about 0.1 to about 1.0% by weight silicon, and from about 0.01 to 0.1% by weight phosphorus.

14. The copper-nickel alloys of claim 13 in which about 0.01 to about 3.0% by weight iron is added to the alloy and alloyed therewith.

15. The copper-nickel alloys of claim 14 in which the alloy consists essentially of about 0.5% by weight nickel, about 0.1% by weight silicon, about 0.03% by weight phosphorus, about 0.7% by weight iron, and the balance copper.

16. The copper-nickel alloys of claim 15 in which the alloy has an elongation of at least about 4.0%.

17. The copper-nickel base alloys of claim 13 in which the alloy has a hardness of 143 HV.

* * * * *